US008627945B2

(12) United States Patent
Krämer et al.

(10) Patent No.: US 8,627,945 B2
(45) Date of Patent: Jan. 14, 2014

(54) CONTAINER TREATMENT MACHINE

(75) Inventors: Klaus Krämer, Dortmund (DE); Oliver Kress, Waltrop (DE); Thomas Stienen, Unna (DE)

(73) Assignee: KHS GmbH, Dortmund (DE)

( * ) Notice: Subject to any disclaimer, the term of this patent is extended or adjusted under 35 U.S.C. 154(b) by 142 days.

(21) Appl. No.: 13/130,764

(22) PCT Filed: Dec. 15, 2009

(86) PCT No.: PCT/EP2009/008955

§ 371 (c)(1),
(2), (4) Date: May 24, 2011

(87) PCT Pub. No.: WO2010/081516

PCT Pub. Date: Jul. 22, 2010

(65) Prior Publication Data

US 2011/0253506 A1 Oct. 20, 2011

(30) Foreign Application Priority Data

Jan. 15, 2009 (DE) ..... 10 2009 005 181

(51) Int. Cl.
*B65C 9/04* (2006.01)

(52) U.S. Cl.
USPC ..... 198/478.1; 198/474.1; 198/470.1

(58) Field of Classification Search
USPC ..... 198/469.1, 470.1, 474.1, 478.1
See application file for complete search history.

(56) References Cited

U.S. PATENT DOCUMENTS

| | | | | |
|---|---|---|---|---|
| 4,279,271 | A * | 7/1981 | Neff | 137/493.8 |
| 4,315,795 | A * | 2/1982 | Jodrey et al. | 156/542 |
| 4,404,900 | A * | 9/1983 | Ozawa et al. | 101/40 |
| 4,735,664 | A | 4/1988 | Asghar et al. | |
| 4,753,275 | A * | 6/1988 | Schaltegger | 141/1 |
| 5,558,200 | A * | 9/1996 | Whitby et al. | 198/470.1 |
| 5,711,411 | A * | 1/1998 | Zurweller | 198/470.1 |
| 6,354,427 | B1 * | 3/2002 | Pickel et al. | 198/470.1 |
| 6,520,318 | B1 * | 2/2003 | Humele | 198/483.1 |
| 6,845,860 | B1 * | 1/2005 | Walker | 198/433 |
| 2008/0223691 | A1 * | 9/2008 | Nishi et al. | 198/470.1 |
| 2008/0257687 | A1 * | 10/2008 | Hermann et al. | 198/469.1 |
| 2010/0192525 | A1 * | 8/2010 | Lam et al. | 53/544 |
| 2011/0278134 | A1 * | 11/2011 | Voth | 198/478.1 |
| 2012/0175224 | A1 * | 7/2012 | Briggs et al. | 198/478.1 |

FOREIGN PATENT DOCUMENTS

| | | | |
|---|---|---|---|
| DE | 1200197 | | 9/1965 |
| DE | 20019839 | U1 * | 2/2001 |
| DE | 20019839 | | 3/2001 |
| EP | 0635452 | | 1/1995 |
| EP | 2161201 | | 3/2010 |
| FR | 2376030 | | 7/1978 |

* cited by examiner

*Primary Examiner* — Patrick Mackey
(74) *Attorney, Agent, or Firm* — Occhiuti & Rohlicek LLP

(57) ABSTRACT

The invention relates to a container treatment machine for treating containers, especially a labeling machine, comprising a rotor which can be driven to revolve about a vertical machine axis and a plurality of treatment positions configured on the rotor and having at least one container support and a clamping and/or centering unit each. Said unit can be displaced in a controlled manner in a controlled travel movement between an initial position and a position which centers and/or clamps the respective container.

20 Claims, 5 Drawing Sheets

CONTAINER TREATMENT MACHINE

CROSS-REFERENCE TO RELATED APPLICATIONS

This application is the National Stage of International Application No. PCT/EP2009/008955, filed on Dec. 15, 2009, which claims the priority of German Patent Application No. 10 2009 005 181.3, filed on Jan. 15, 2009. The contents of both applications are hereby incorporated by reference in their entirety.

FIELD OF DISCLOSURE

This disclosure relates to container treatment machines.

BACKGROUND

Containers in the context of the invention are containers or container-like packaging means of all kinds of the type used for packing products, e.g. beverages, foods, cosmetics, drugs etc. Containers in the context of the present invention therefore particularly include bottles, cans or other bottle-like or can-like containers made from very diverse materials, e.g. metal, glass or plastic, for example PET.

Container treatment machines and those comprising a rotary are particularly also known as labelling machines of very diverse construction. Inspection machines wherein the containers are for example, optically examined for damage and/or impurities are also known as rotary container treatment machines.

Known rotary container treatment machines comprise inter alia a carrousel or rotor which can be driven to rotate about a vertical machine axis, and which on at least one (first) rotor element configures a plurality of container carriers, for example in the form of container plates, which can e.g. be rotated or swivelled under control, and at least one further (second) rotor element permanently connected to the first rotor element and comprising a plurality of function elements e.g. in the form of clamping and/or centering elements each assigned to one container carrier, whereby the said elements can be displaced in a controlled manner by a cam on a section of a machine frame that does not rotate with the rotor (carrier element as lift cam carrier), for example are movable up and down through a predefined vertical lift, i.e. parallel to the machine axis.

Particularly when the container treatment machine is embodied as a labelling machine, the containers to be treated, i.e. labelled, are fed sequentially via a container inlet to the treatment stations or treatment positions each configured on the rotor of a container carrier and clamping and/or centering element (e.g. centering tulip), whereby the clamping and/or centering element concerned is lowered in a controlled way onto the top or head of a container at the moment when the container is transferred to a treatment position, such that for the treatment, the container is centered with its vertical container axis relative to the container carrier or the latter's axis and held clamped between the container carrier and the clamping and/or centering element. The containers are treated during the rotary motion within the angular range between the container inlet and the container outlet. At the container outlet, the clamping and/or centering element concerned is lifted off each container with the lifting cam and the container is then taken off or removed from the treatment position concerned.

With known container treatment machines the raising and lowering of the clamping and/or centering elements or centering tulips is effected by fixed-position curved paths or cams into which control rollers on the clamping and/or centering elements rotating with the rotor engage. When being clamped at the treatment position, each clamping and/or centering element is pressed on the container concerned by the force of a pre-tensioned spring with a closing force or head force which is determined inter alia by the spring constant of the compression springs which are used and by the container height such that a clamping force which is dependent on the container height is obtained, i.e. in particular a clamping force dependent on dimensional and manufacturing tolerances of the containers. The compression springs which are used, or their spring constants, are usually selected so that even containers with a low container height are clamped with force sufficient to securely hold these containers at the treatment positions even at high speed of the rotor and high angular accelerations and to press them against the respective container carrier with sufficient firmness.

During labelling and/or aligning or centering, each container is subjected inter alia to considerable angular accelerations and resulting acceleration forces which it can only withstand if pressed with sufficient force against the container carrier concerned. The container carriers are preferably rotatable or pivotable under control in order to respectively rotate or swivel the container concerned during the treatment, e.g. during labelling. For a reliable transmission of this controlled rotary motion to the container, the container carriers are preferably equipped with a friction lining, in addition to the quality of the friction lining the force by which the container is clamped between the clamping and/or centering element and the container carrier is essential for the reliable entrainment and rotary and swivelling motion of the container.

SUMMARY

The usual clamping or closing force ranges from 120-250 N. Although containers which are common today, particularly normal containers made from glass, are able easily to withstand these forces. For reasons of material savings and cost savings there are constant endeavours on the part of drinks' manufacturers and others to further reduce the weight of the containers, leading to the necessity of containers with reduced wall thickness and/or strength.

The object of the invention is to provide a container treatment machine, particularly a labelling machine, which makes it possible to control or regulate the closing force with which the particular centering or clamping element is in contact against a container as accurately as possible and irrespective of tolerances, especially in container height.

In the present invention, the clamping and/or centering units are each equipped with independent actuating elements that allow, including in particular by force-control, an individual actuation of the clamping and/or centering units and hence of the clamping and/or clamping and/or centering elements thereon such that an exactly preselected, e.g. a maximum permissible, closing force is applied on the particular container with the clamping and/or centering element lowered onto the container and without dimensional tolerances or variations in the container creating a risk of damage or container breakage by a maximum permissible closing force being exceeded.

The use of independently controllable actuating elements, i.e. which independently execute the lifting motions of the clamping and/or centering elements, can obviate the need for the extremely cost-intensive lifting cam of the type usually found in conventional treatment machines, and particularly conventional labelling machines. The overall construction of a container treatment machine can also be significantly simplified as a result.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or their cross-references. The content of the claims also forms an integral part of the description.

The invention is explained in detail below through the use of embodiment examples with reference to the figures. In the figures:

DETAILED DESCRIPTION

Figure 1:
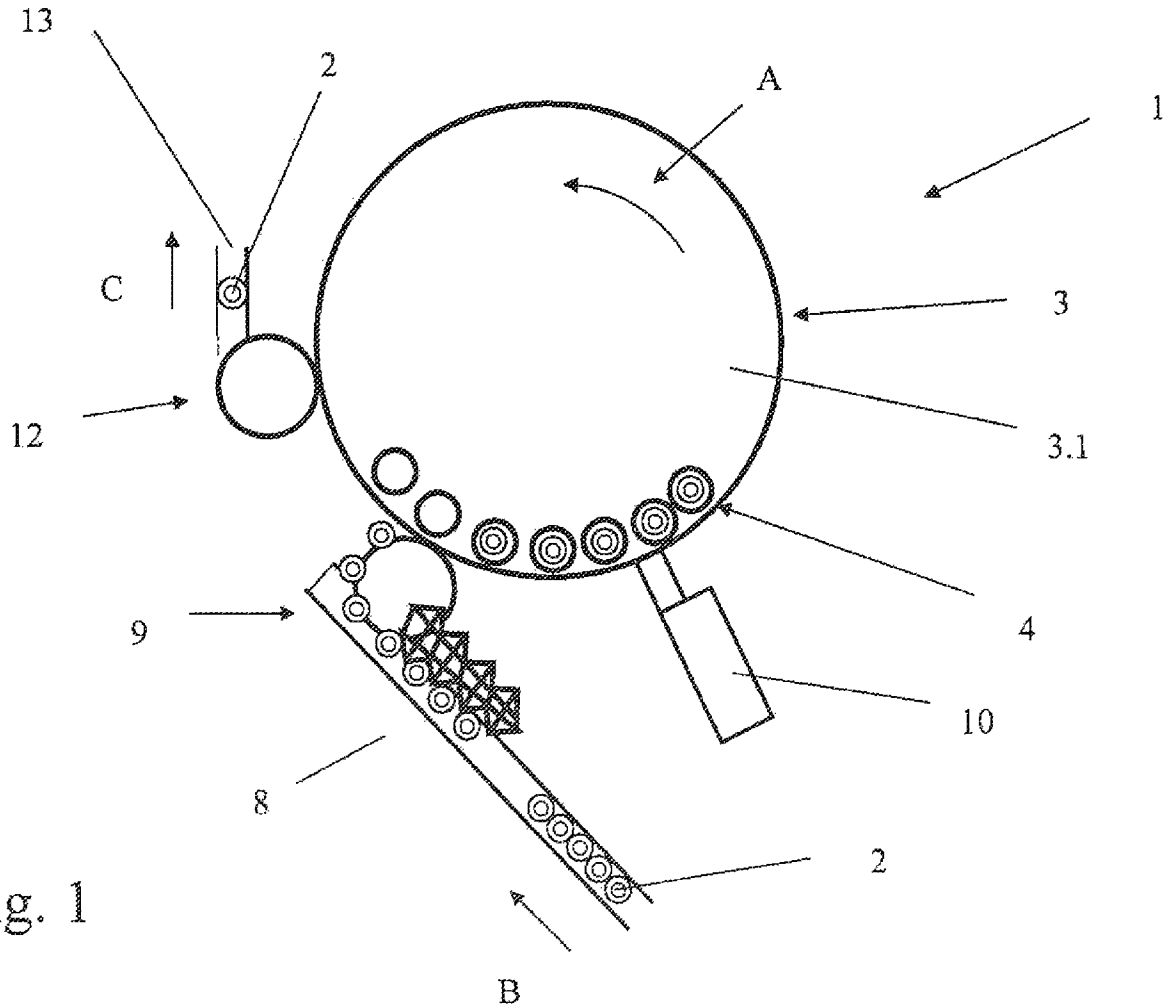
FIG. 1 shows a schematic representation and plan view of a container treatment machine in the form of a labelling machine.
Figure 2:
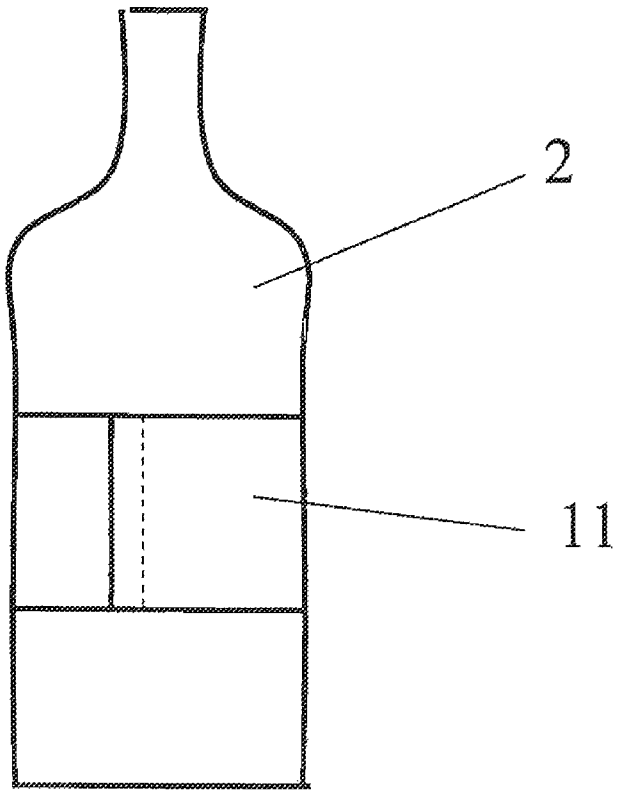
FIG. 2 shows a single representation of a container in the form of a bottle.

In the figures, 1 is a container treatment machine in the form of a labelling machine for labelling containers in the form of bottles 2. Treatment machine 1 comprises—in a manner which is in itself known—a rotor 3 which can be driven to rotate about a vertical machine axis MA (arrow A) and on whose rotor element 3.1 are disposed a plurality of treatment positions 4 offset at equal angular distances about the machine axis, each consisting of a rotary or bottle plate 5 forming a base for the bottles 2 and of a clamping and/or centering unit 6 arranged above bottle plate 5 with clamping and/or centering element 7 in the form of a centering tulip.

Bottles 2 are fed standing upright to treatment machine 1 by an external conveyor 7 (arrow B in FIG. 1) and are each transferred through a container inlet 8 formed by a one-piece worm and subsequent transport star to a treatment position 4, such that each bottle 2 stands with its base on bottle plate 5. At the moment of transfer the initially raised clamping and/or centering element 7 is lowered down onto the head of the respective bottle 2 so that said bottle is centered with its vertical bottle axis relative to axis FA of the respective bottle plate 5 and clamped between bottle plate 5 and clamping and/or centering element 7 or the centering tulip which picks up bottle 2 by its bottle head. Bottles 2 which are centered and held at treatment positions 4 in this way are conveyed by rotating rotor 3 past at least one labelling unit 10 which applies one label to each bottle 2, for example by first transferring a leading end of the label 11 concerned to the respective bottle 2 and then laying it or rolling it out over the bottle's outer surface as bottle 2 or respective bottle plate 5 is rotated about the vertical axis FA that runs parallel to the machine axis MA.

The application of labels 11 to bottles 2 can of course also be effected in other ways, for example by transferring glued labels 11 to bottles 2 and by pressing on the labels with the use of pressing elements and/or brushes which are provided in direction of rotation A following labelling unit 10, again preferentially during the controlled rotation and/or swivelling of the respective bottle 2 about axis FA of associated bottle plate 5. The rotating or swivelling of bottle plate 5 is effected for example by at least one control cam or at least one drive, for example by a drive common to all bottle plates 5, or by drives provided for groups of bottle plates 5 or for each bottle plate 5 separately. Bottle plates 5 are advantageously provided with at least one friction lining on their upper face.

After the raising of clamping and/or centering units 6 or clamping and/or centering elements 7, bottles 2 provided with labels 11 are removed from individual treatment positions 4 at a container outlet 12 formed by a transport star, and passed to an external conveyor 13 which conveys the labelled bottles 2 to a further use (arrow C in FIG. 1).

One particularity of treatment machine 1 is that for the upward and downward motion (double arrow D) of clamping and/or centering units 6 with the clamping and/or centering elements 7 in axis FA, an autonomous actuating element 14, e.g. in the form of a pneumatic, hydraulic, electric, electromotive or electromagnetic actuator, is provided for each clamping and/or centering unit 6. These actuators can be e.g. at least one pneumatic or hydraulic cylinder or an electromotive motion gear or an electromagnetic linear drive or an electromagnetic lifting element. Actuating elements 14 are provided on a common rotor element 3.2, configured for example as a disc, which is mechanically connected for example to the rest of rotor 3 and rotates together with it.

Basically however it is also possible for rotor element 3.2 to be supported rotatably about machine axis MA on a machine frame independently of the rest of rotor 3, and in particular independently of rotor element 3.1 exhibiting bottle plates 5 or other bottle or container carriers. Rotor element 3.1 and rotor element 3.2 can then each be driven synchronously and in the same direction by autonomous drives or by a common drive, i.e. particularly also with exact angular timing and with the same angular velocity, whereby in the case of a common drive, rotor elements 3.1 and 3.2 are connected by this common drive for driving purposes only.

Figure 3:
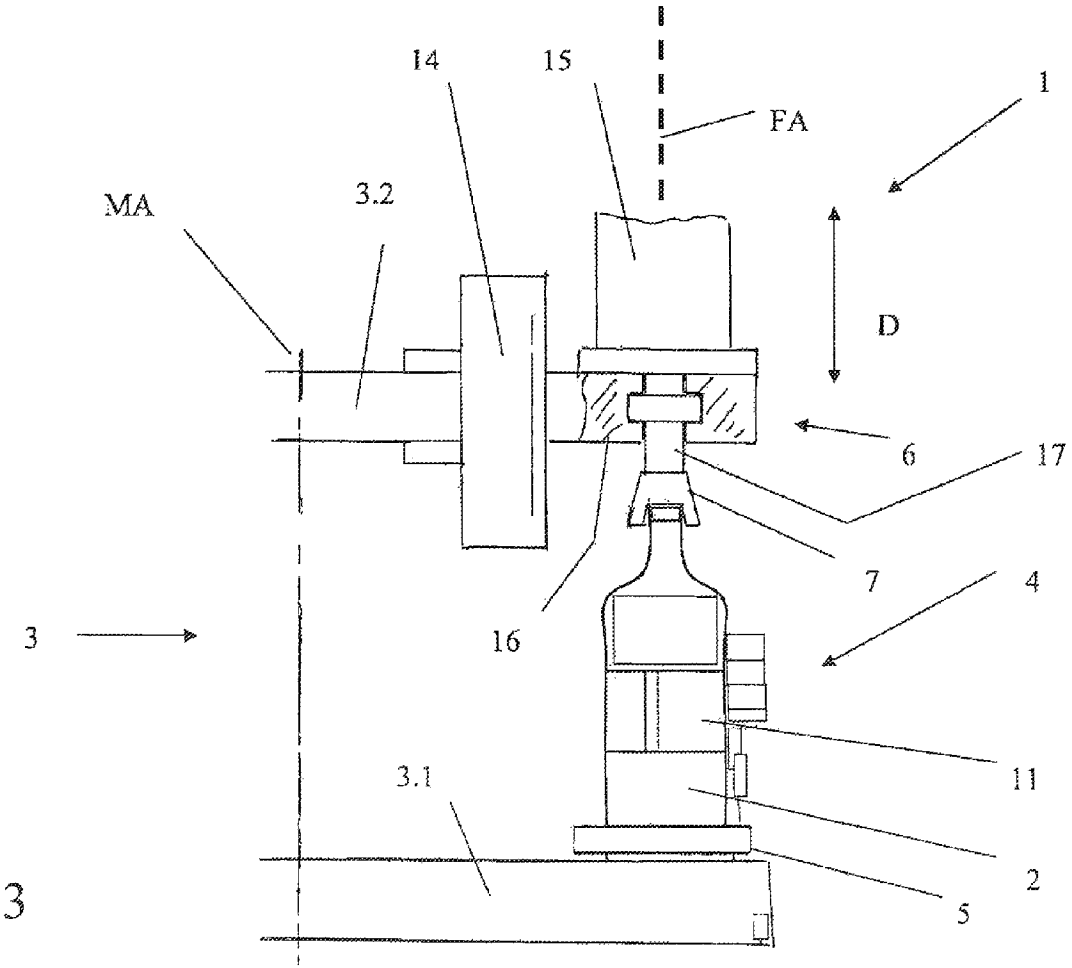
FIG. 3 shows a single representation of a treatment position of the treatment machine in FIG. 1.

FIG. 3 depicts another extremely advantageous embodiment of the present invention. In this embodiment, each clamping and/or centering unit 6 is provided with an actuator motor or servo motor 15 which effects the controlled rotation of respective bottles 2 about their bottle axis or about axis FA, said motor being on top of a carriage or support element 16 which can be raised and lowered in a controlled manner with actuating element 14 as indicated by arrow D. Output shaft 17 of actuator motor 15 is arranged on the same axis as axis FA and can rotate in, but cannot be axially displaced in, support element 16. The respective clamping and/or centering unit is provided at the lower end of output shaft 17.

Actuating elements 14 are individually controllable, particularly in a manner in which clamping and/or centering elements 7 lie against the head of the respective bottle 2 under force-control, i.e. with a predetermined optimally selected closing force which on the one hand provides sufficiently strong tensioning of bottles 2 between clamping and/or centering unit 6 or clamping and/or centering element 7 and bottle plate 5 as is necessary inter alia for the controlled rotation and swivelling of bottles 2 with actuator motors 15 about respective axis FA and for the secure gripping of bottles 2, while on the other hand reliably avoiding the destruction or unacceptable distortion of bottles 2, including in particular bottles made from plastic, for example PET.

Bottle plates 5 are for example mounted free to rotate about axis FA on rotor element 3.2. It is however fundamentally possible to also provide a for example autonomous drive for bottle plates 5 with which each bottle plate 5 is rotated or swivelled synchronously with the rotational motion of actuator motor 15 during the controlled rotation or swivelling of bottle 2 about axis FA.

The force control, i.e. the control or regulation of the closing force with which clamping and/or centering elements 7 lie against respective bottles 2, can be realised in very diverse ways, for example taking account of and/or controlling and/or regulating the pneumatic or hydraulic pressure in case of pneumatic or hydraulic actuating elements 14, in case of electric actuating elements 14 taking account of and/or controlling and/or regulating the voltage and/or electric current for actuating elements 14, and/or by way of sensor devices which capture the force that is applied to the particular bottle 2 by the clamping and/or centering units 6.

The closing force with which clamping and/or centering unit 6 or its clamping and/or centering element 7 (centering tulip) lies against the respective bottle 2 is for example 120 to 270 N, preferably about 160 N.

Figure 4:
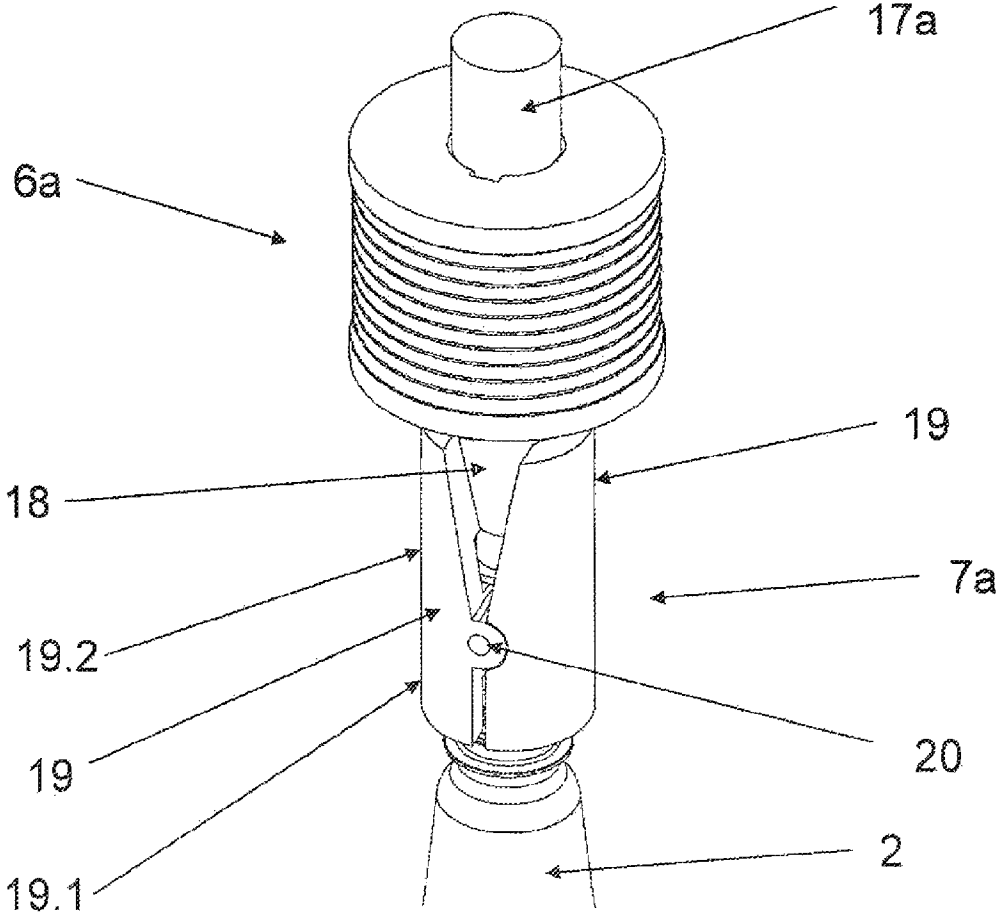
FIGS. 4 and 5 show a single representation of a clamping and/or centering element in the form of a clamping and centering element for use in a container treatment machine, in perspective view and in side view, in each case together with a partial representation of a container in the form of a bottle.
Figure 5:
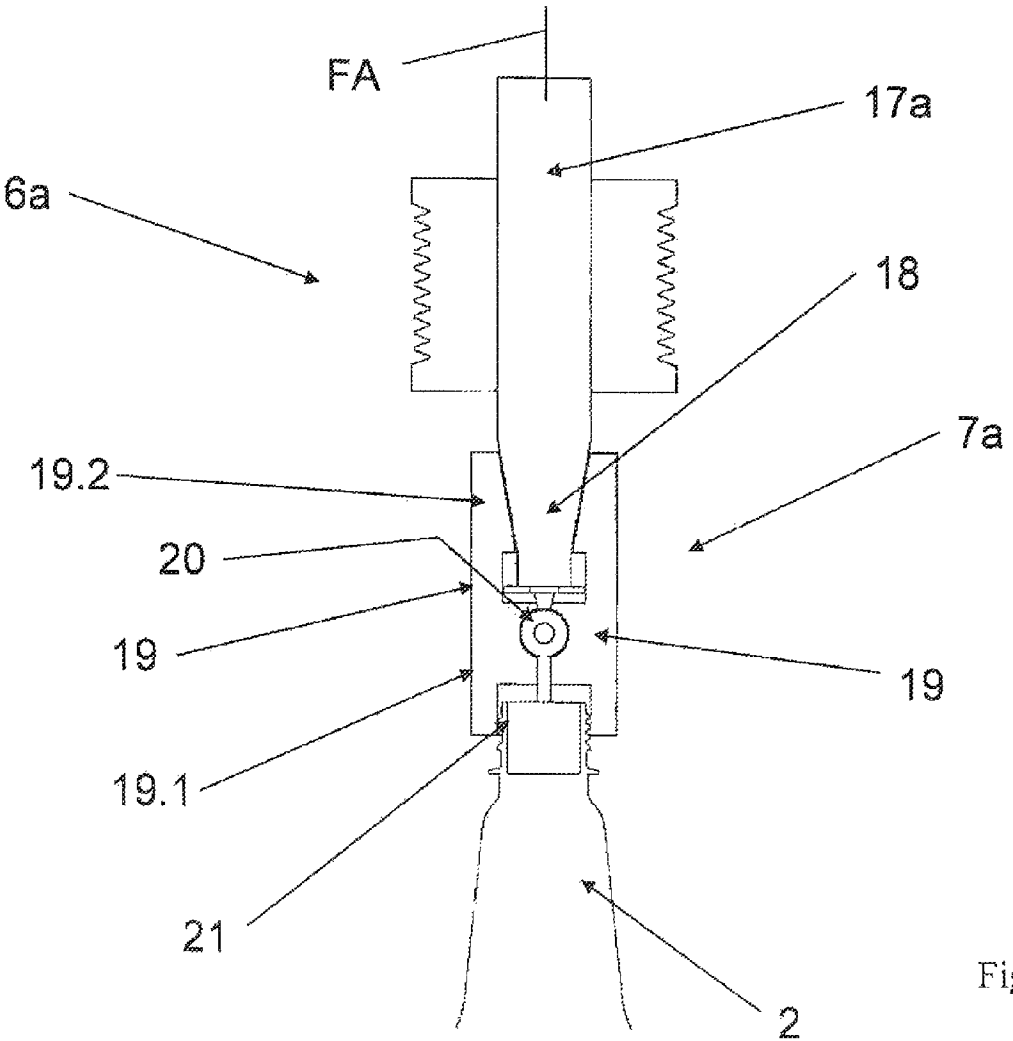

FIGS. 4 and 5 show in simplified representation a clamping and/or centering unit 6*a* which can be provided at the particular treatment position 4 instead of clamping and/or centering unit 6. Whereas with lowered clamping and/or centering units 6, bottles 2 are only picked up in the respective clamping and/or centering element 7 by the bottle head fitted with the bottle cap, each clamping and/or centering unit 6*a* is equipped with a centering and gripping element or with a centering and clamping element 7*a*.

The particular centering and clamping element 7*a* is provided at the lower tapering end 18 of shaft 17*a* which corresponds to shaft 17 in such a way that the centering and clamping element 7*a* can be displaced axially by a certain travel on shaft 17*a* but rotates with shaft 17*a*.

Each centering and clamping element 7*a* consists essentially of two flexibly interconnected clamping jaws 19 which are interconnected by a pivot 20 and which with lower clamping jaw sections 19.1 together form a holder 21 that is open on the underside of centering and clamping element 7*a* that faces bottle plate 5 (not shown), and serves to clamp and grip the particular bottle 2 by its head. Upper clamping jaw sections 19.2 interact with the tapered surface of shaft end 18.

Spring means (not shown) pre-tension the particular centering and clamping element 7*a* in the open position of holder 21 such that during the controlled lowering of clamping and/or centering unit 6*a* onto a bottle 2, the bottle head is initially received in the open holder 21 which centers bottle 2 relative to axis FA, and then during the continued lowering of the clamping and/or centering unit 6*a* over the tapered surface of shaft end 18, the centering and clamping element 7*a* or its holder 21 is closed so as to tightly clamp the bottle head. The particular bottle 2 is then held on shaft 17*a* by clamping, and in this condition can be rotated under control about axis FA with the actuator motor of the clamping and/or centering unit 6*a*.

When clamping and/or centering unit 6*a* is used, the closing force with which it or its centering and clamping elements 7*a* lie against the head of bottle 2 is also controlled or regulated to achieve optimum conditions, once again by the corresponding individual operation of associated actuating elements 14. However the use of the clamping and/or centering units 6*a* equipped with centering and clamping elements 7*a* has the additional advantage that significantly reduced closing forces can be selected, for example in the range of about just 60 N or less.

The use of centering and clamping elements 7*a* is particularly advantageous with containers or bottles 2 that are manufactured from plastic, for example PET, by stretch blow moulding or stretch blowing, because containers of such type have a greater wall thickness in the head region and so the containers or bottles 2 can be safely gripped by the centering or clamping elements 7*a*.

The invention has been described hereinbefore by reference to embodiments. It goes without saying that numerous variations as well as modifications are possible without departing from the inventive concept underlying the invention.

As already explained, the term container treatment machine also refers to rotary-type inspection machines within the scope of the present invention. With these inspection machines the containers or bottles 2 are fed to or removed from rotor 3 in a manner similar to a labelling machine. When the containers or bottles 2 are subsequently at their treatment position, they are also secured in the correct attitude at the treatment positions by clamping or centering units 6, 6*a* or centering and clamping elements 7, 7*a*.

During the rotary motion of rotor 3 the containers or bottles 2 are then moved past at least one inspection device which inspects the containers or bottles 2 in an appropriate manner. The inspection may involve an optical examination, for example. It may equally involve an X-ray, ultrasonic, temperature or other examination however.

Within the Applicant's company, the keyword "automatic centering tulip" has been coined for the present innovation.

REFERENCE LIST

1 Container treatment machine
2 Bottle
3 Rotor
3.1,3.2 Rotor element
4 Treatment position
5 Rotary or bottle plate
6, 6*a* Clamping and/or centering unit
7, 7*a* Clamping and/or centering element or centering tulip
8 Conveyor
9 Container entry
10 Labelling unit
11 Label
12 Container exit
13 Conveyor
14 Actuating element
15 Actuator motor
16 Support element or carriage
17, 17*a* Output shaft
18 Shaft end
19 Clamping jaws
19.1, 19.2 Clamping jaw section
20 Pivot
21 Holder
A Direction of rotation of rotor 3
B Transport direction of conveyor 8
C Transport direction of conveyor 13
D Lifting motion of clamping and/or centering unit 6 or 6*a*
FA Rotational or pivot axis of the rotary or bottle plate 5 and of shaft 17 and 17*a*
MA Machine axis

The invention claimed is:

1. An apparatus for treating containers said apparatus comprising a container treatment machine having a rotor, a plurality of treatment positions, a plurality of clamping and/or centering units, and a plurality of autonomous and/or individually controllable motorized actuating elements, wherein said plurality of clamping and/or centering units comprises at least a first clamping and/or centering unit and a second clamping and/or centering unit, wherein said plurality of autonomous and/or individually controllable motorized actuating elements comprises at least a first autonomous and/or individually controllable motorized actuating element and a second autonomous and/or individually controllable motorized actuating element, wherein said rotor is drivable to rotate about a vertical machine axis of said container treatment machine, wherein each of said treatment positions comprises at least one container carrier, wherein said first clamping and/or centering unit is movable, under control of said first autonomous and/or individually controllable motorized actuating element, between a first position and a second position, wherein said first autonomous and/or individually controllable motorized actuating element causes said first clamping and/or centering unit to move between said first position and said second position, wherein, when said first clamping and/or centering unit is in said second position, said first individually controllable motorized actuating element causes said first clamping and/or centering unit to apply a first preselected clamping force to said first container, said first preselected clamping force being independent of said first container height, wherein, in said second position, said first clamping and/or centering unit engages a first container having a first container height, and wherein in said first position, said first clamping and/or centering unit disengages from said first container, wherein said second clamping and/or centering unit is movable, under control of said second autonomous and/or individually controllable motorized actuating element, between a first position and a second position, wherein in said second position said second clamping and/or centering unit engages a second container having a second container height, and wherein in said first position, said second clamping and/or centering unit disengages from said second container, wherein said second autonomous and/or individually controllable motorized actuating element causes said second clamping and/or centering unit to move between said first position and said second position independently of movement of said first clamping and/or centering unit, and wherein, when said second clamping and/or centering unit is in said second position, said second individually controllable motorized actuating element causes said second clamping and/or centering unit to apply a second preselected clamping force to said second container, said first preselected clamping force being independent of said second container height, and wherein said second preselected clamping force is independent of said first preselected clamping force.

2. The apparatus of claim 1, wherein the first autonomous and/or individually controllable motorized actuating element comprises a pneumatic actuating element.

3. The apparatus of claim 1, wherein the first and second autonomous and/or individually controllable motorized actuating elements are controlled or regulated in such a way that the first and second pre-selected clamping forces acting on the container are within the range 120-270 N.

4. The apparatus of claim 1, wherein the clamping and/or centering units each have a clamping and/or centering element.

5. The apparatus of claim 1, wherein each clamping and/or centering unit comprises a gripper head for holding the container.

6. The apparatus of claim 1, wherein the container treatment machine further comprises, at each of the treatment positions, means for rotating or swivelling the containers about their respective container axes.

7. The apparatus of claim 6, wherein the means for rotating or swivelling the containers comprises an actuator motor for controlled rotating or swivelling of at least one of the container carrier and the centering or clamping element of the treatment position that interacts with the container.

8. The apparatus of claim 1, wherein the lifting motion of the clamping and/or centering units is effected solely by the first and second autonomous and/or individually controllable motorized actuating elements.

9. The apparatus of claim 1, wherein the lifting motion of the clamping and/or centering units is generated without the use of a curved-path control system.

10. The apparatus of claim 1, wherein the first autonomous and/or individually controllable motorized actuating element comprises a hydraulic actuating element.

11. The apparatus of claim 1, wherein the first autonomous and/or individually controllable motorized actuating element comprises an electric element.

12. The apparatus of claim 1, wherein the first autonomous and/or individually controllable motorized actuating element comprises an electromotive actuating element.

13. The apparatus of claim 1, wherein the first autonomous and/or individually controllable motorized actuating element comprises an electromagnetic actuating element.

14. The apparatus of claim 1, wherein the first and second autonomous and/or individually controllable motorized actuating elements are controlled such that the first and second pre-selected clamping forces on a container are each about 160 N.

15. The apparatus of claim 5, wherein the gripper head is configured to clamp a container head of the container.

16. The apparatus of claim 5, wherein the gripper head comprises a clamping element.

17. The apparatus of claim 5, wherein the gripper head comprises a centering and clamping element.

18. The apparatus of claim 4, wherein the clamping and/or centering element is configured in the form of a centering tulip.

19. The apparatus of claim 1, wherein the first and second autonomous and/or individually controllable motorized actuating elements are controlled such that the first and second pre-determined clamping force on a container are 60 N or less.

20. The apparatus of claim 1, wherein said autonomous and/or individually controllable motorized actuating elements provided with each of said clamping and/or centering units is configured to apply a predetermined optimally selected clamping force.

* * * * *